US007690767B2

(12) United States Patent
Hirosawa et al.

(10) Patent No.: US 7,690,767 B2
(45) Date of Patent: Apr. 6, 2010

(54) INK JET RECORDING HEAD AND INK JET RECORDING APPARATUS

(75) Inventors: Toshiaki Hirosawa, Hiratsuka (JP); Shuzo Iwanaga, Kawasaki (JP); Yasutomo Watanabe, Hiratsuka (JP); Riichi Saito, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 554 days.

(21) Appl. No.: 11/628,359

(22) PCT Filed: Jul. 14, 2005

(86) PCT No.: PCT/JP2005/013439

§ 371 (c)(1),
(2), (4) Date: Dec. 4, 2006

(87) PCT Pub. No.: WO2006/009236

PCT Pub. Date: Jan. 26, 2006

(65) Prior Publication Data

US 2007/0242102 A1 Oct. 18, 2007

(30) Foreign Application Priority Data

Jul. 22, 2004 (JP) ..... 2004-214239

(51) Int. Cl.
*B41J 2/05* (2006.01)

(52) U.S. Cl. ..... 347/56; 347/59

(58) Field of Classification Search ..... 347/50, 347/56, 58, 59

See application file for complete search history.

(56) References Cited

U.S. PATENT DOCUMENTS

| | | | | |
|---|---|---|---|---|
| 4,791,440 | A | 12/1988 | Eldridge et al. | |
| 6,084,612 | A * | 7/2000 | Suzuki et al. | 347/50 |
| 6,123,410 | A | 9/2000 | Beerling et al. | |
| 6,132,031 | A | 10/2000 | Watanabe | |
| 6,241,340 | B1 | 6/2001 | Watanabe et al. | |
| 6,257,703 | B1 | 7/2001 | Hirosawa et al. | |
| 6,332,669 | B1 | 12/2001 | Kato et al. | |
| 6,371,604 | B1 | 4/2002 | Yamane et al. | |

(Continued)

FOREIGN PATENT DOCUMENTS

EP 0 289 347 A2 11/1988

(Continued)

*Primary Examiner*—An H Do
(74) *Attorney, Agent, or Firm*—Fitzpatrick, Cella, Harper & Scinto

(57) ABSTRACT

A highly reliable, compact, and inexpensive ink jet recording head, includes a liquid discharge substrate having on a front surface side a discharge port for discharging a liquid, and having, on a back surface side, a liquid supply port for supplying the liquid to be discharged from the discharge port, and an electrode for transmitting and receiving a signal to drive energy generation means for discharging the liquid from the discharge port; a film-like electrical wiring member joined to the back surface of the liquid discharge substrate, the film-like electrical wiring member including a liquid supply hole communicating with the liquid supply port of the liquid discharge substrate, and an electrical connection portion connected to the electrode; and a retaining member for retaining the liquid discharge substrate with the electrical wiring member interposed therebetween, the retaining member including a liquid supply port for supplying the liquid to the liquid supply port of the liquid discharge substrate.

5 Claims, 16 Drawing Sheets

U.S. PATENT DOCUMENTS

| | | | | |
|---|---|---|---|---|
| 6,471,901 | B1 | 10/2002 | Kawamura et al. | |
| 6,935,726 | B2 | 8/2005 | Watanabe | |
| 7,287,832 | B2 * | 10/2007 | Hayasaki | 347/50 |

FOREIGN PATENT DOCUMENTS

| | | | |
|---|---|---|---|
| JP | 63-274556 | A | 11/1988 |
| JP | 9-207346 | A | 8/1997 |
| JP | 9-226115 | A | 9/1997 |
| JP | 11-192705 | A | 7/1999 |
| JP | 11-320873 | A | 11/1999 |
| JP | 2001-150680 | A | 6/2001 |

* cited by examiner

INK JET RECORDING HEAD AND INK JET RECORDING APPARATUS

TECHNICAL FIELD

The present invention relates to a recording head applied to a recording apparatus for discharging a recording liquid such as ink, thereby performing a recording operation, and more particularly to a connection between a liquid discharge substrate and a wiring board, which are applied to the recording head.

BACKGROUND ART

In general, an ink jet recording head for use in an ink jet recording apparatus is composed of an ink jet recording head for forming droplets of a liquid such as ink, and of a supply system for supplying the ink and the like to the head.

With regard to a connection of a wiring board to a liquid discharge substrate, which are applied to the recording head, a wide-array ink jet apparatus composed of a printhead substrate in which an electrical connection electrode is present on a surface opposite to a surface having a discharge port therein has been disclosed in JP 11-192705A. In FIG. 18 and FIG. 19, a wide-array ink jet pen 210 disclosed in JP 11-192705A is shown. FIG. 18 is a perspective view of the wide-array ink jet pen having a wide-array printhead. FIG. 19 is a cross-sectional view of a part including a printhead die and a carrier substrate 220, showing electrical connection portions of the wide-array ink jet printhead of FIG. 18. The pen 210 is composed of a wide-array printhead 212 and a pen body 214. The pen body 214 is a housing to which the printhead 212 is attached. In the pen body 214, an internal chamber 216 serving as a local ink reservoir is present. Further, referring to FIG. 18 and FIG. 19, the printhead 212 includes plural printheads 218 attached to the carrier substrate 220. In each printhead 218, electrodes 284 for making an electrical connection and an ink supply port 242 are formed on the back surface side of a surface on which a nozzle opening 238 is formed. In the carrier substrate 220 for retaining the printhead 218, electrical wiring is installed on a first surface 270 and second surface 272 thereof, and on the first surface 270 side, the carrier substrate 220 makes the electrical connection with the printhead 218 by solder bumps, and is thus disposed. Further, a logic circuit (not shown) and a drive circuit 230 are mounted on the second surface 272 opposite to the first surface in the substrate 220.

Problems as described below are inherent in the ink jet recording head formed as described above, in which the ink supply port is formed on the back surface side of the surface of the liquid discharge substrate in which the nozzle opening is formed, the connection electrodes for making the electrical connection with the other members are provided in the vicinity of the ink supply port, and the electrical connection is made with the surface of the carrier substrate on which the electrical wiring is formed.

For example, in the ink jet recording head of FIG. 19, the ink supply ports individually formed in the carrier substrate and the liquid discharge substrate must be made to communicate with each other. Specifically, it is necessary to completely prevent the ink from entering the electrical connection portions and completely prevent the ink from leaking to the outside by forming a partition wall for surely separating a fluid on the periphery of the ink supply port.

For this purpose, dimensional and positional accuracies of the ink supply port of the liquid discharge substrate and the ink supply port of the carrier substrate become an important point.

In the head disclosed in JP 11-192705A, as shown in FIG. 19, the carrier substrate 220 is formed of a plate-like member with some thickness, which is formed of silicon, multilayer ceramics, or glass epoxy, such as one used for forming a hybrid multi-chip module.

Hence, since the head is poor in processability, the positional accuracy of the opening of the ink supply port 242 and the dimensional accuracy of the opening thereof are not very high, and accordingly, a displacement is prone to occur in a relative position thereof to the ink supply port of the liquid discharge substrate. This proves particularly troublesome in the case of using an adhesive or a sealing agent on the fluid partition wall of the ink supply port. In the case of such a construction, a position of the adhesive or the sealing agent is greatly affected by a position of an end of the ink supply port of the carrier substrate, and accordingly, when a position of an end surface of the ink supply port of the carrier substrate is overlapped with the position of the ink supply port of the liquid discharge substrate, there occurs such a problem that the adhesive or the sealing agent flows into the ink supply port of the liquid discharge substrate. Further, in the ink jet head, a necessity to array the plural liquid discharge substrates whose width is as narrow as possible at high density has increased from viewpoints of cost and size. Therefore, it is also necessary to form the ink supply ports of the liquid discharge substrate and the carrier substrate to be narrow in width and at high density. However, in the carrier substrate disclosed in FIG. 19, it is difficult to accurately form the ink supply ports narrow in width because the carrier substrate has some thickness.

DISCLOSURE OF INVENTION

It is an object of the present invention to provide a highly reliable, compact, and inexpensive ink jet recording head that solves the above-described problems. Further, it is also an object of the present invention to provide an ink jet recording apparatus using the recording head.

Further, it is another object of the present invention to provide an ink jet recording head in which a position and dimension of an opening communicating from a liquid supply port of a retaining member to a liquid supply port of a liquid discharge substrate can be determined by opening dimension and position of a liquid supply hole of a film-like electrical wiring member that is processable accurately and finely. Further, it is also another object of the present invention to provide an ink jet recording apparatus using the recording head.

Further, it is still another object of the present invention to provide an ink jet recording head capable of preventing a sealing agent from flowing into a liquid supply port of a liquid discharge substrate at a time of sealing electrical connection portions by filling the sealing agent between the liquid discharge substrate and an electrical wiring substrate and of forming a fluid partition wall formed so as not to allow leakage of a liquid to a periphery of the liquid supply port. Further, it is also still another object of the present invention to provide an ink jet recording apparatus using the recording head.

Further, it is yet still another object of the present invention to provide an ink jet recording head including: a liquid discharge substrate having on a front surface side a discharge port for discharging a liquid, and having, on a back surface side, a liquid discharge port for supplying the liquid discharged from the discharge port, and an electrode for transmitting and receiving a signal to drive energy generation means for discharging the liquid from the discharge port; a film-like electrical wiring member joined to the back surface of the liquid discharge substrate, the film-like electrical wiring member including a liquid supply hole communicating with the liquid supply port of the liquid discharge substrate, and an electrical connection portion connected to the electrode; and a retaining member for retaining the liquid discharge substrate with the electrical wiring member interposed therebetween, the retaining member including a liquid supply port for supplying the liquid to the liquid supply port of the liquid discharge substrate.

Further, it is also yet another object of the present invention to provide an ink jet recording apparatus using the recording head.

At the time of sealing the electrical connection portions by filling the sealing agent between the liquid discharge substrate and the electrical wiring substrate and of forming the fluid partition wall that does not allow leakage of the liquid to the periphery of the liquid supply port, it is possible to prevent the sealing agent from flowing into the liquid supply port of the liquid discharge substrate.

The position and dimension of the opening communicating from the liquid supply port of the retaining member to the liquid supply port of the liquid discharge substrate is determined by the opening dimension and position of the liquid supply hole of the film-like electrical wiring member that is processable accurately and finely.

It is another object of the present invention to provide a highly reliable, compact, and inexpensive ink jet recording head that solves the above-described problems. Further, it is also an object of the present invention to provide an ink jet recording apparatus using the recording head.

BRIEF DESCRIPTION OF DRAWINGS

FIG. 8A is a schematic diagram showing the 5-5 cross-section in FIG. 1; and FIG. 8B is a schematic diagram showing the 6-6 cross-section in FIG. 1.

BEST MODE FOR CARRYING OUT THE INVENTION

Embodiments of the present invention will be described below with reference to the drawings.

First Embodiment

Figure 1:
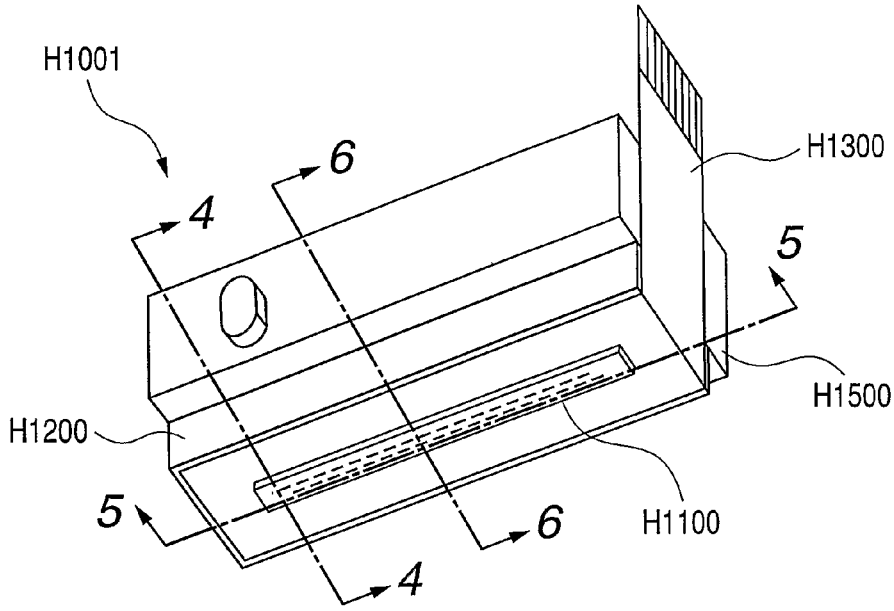
FIG. 1 is an exterior perspective view showing the entirety of an ink-jet recording head as a first embodiment of the present invention.
Figure 2:
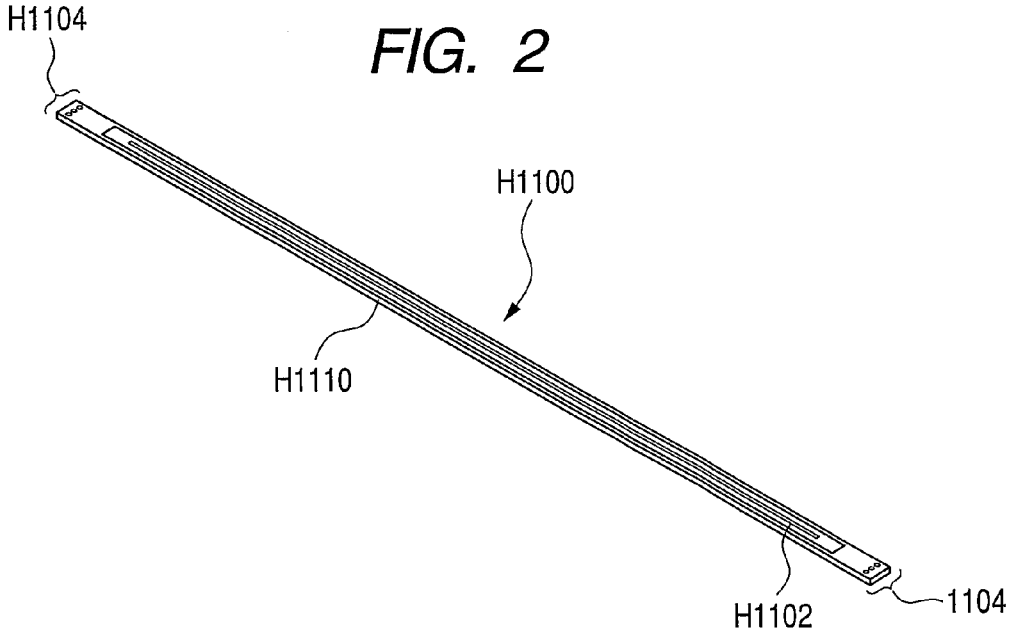
FIG. 2 is a schematic perspective view of a liquid discharge substrate for use in the ink jet recording head shown in FIG. 1.
Figure 3:
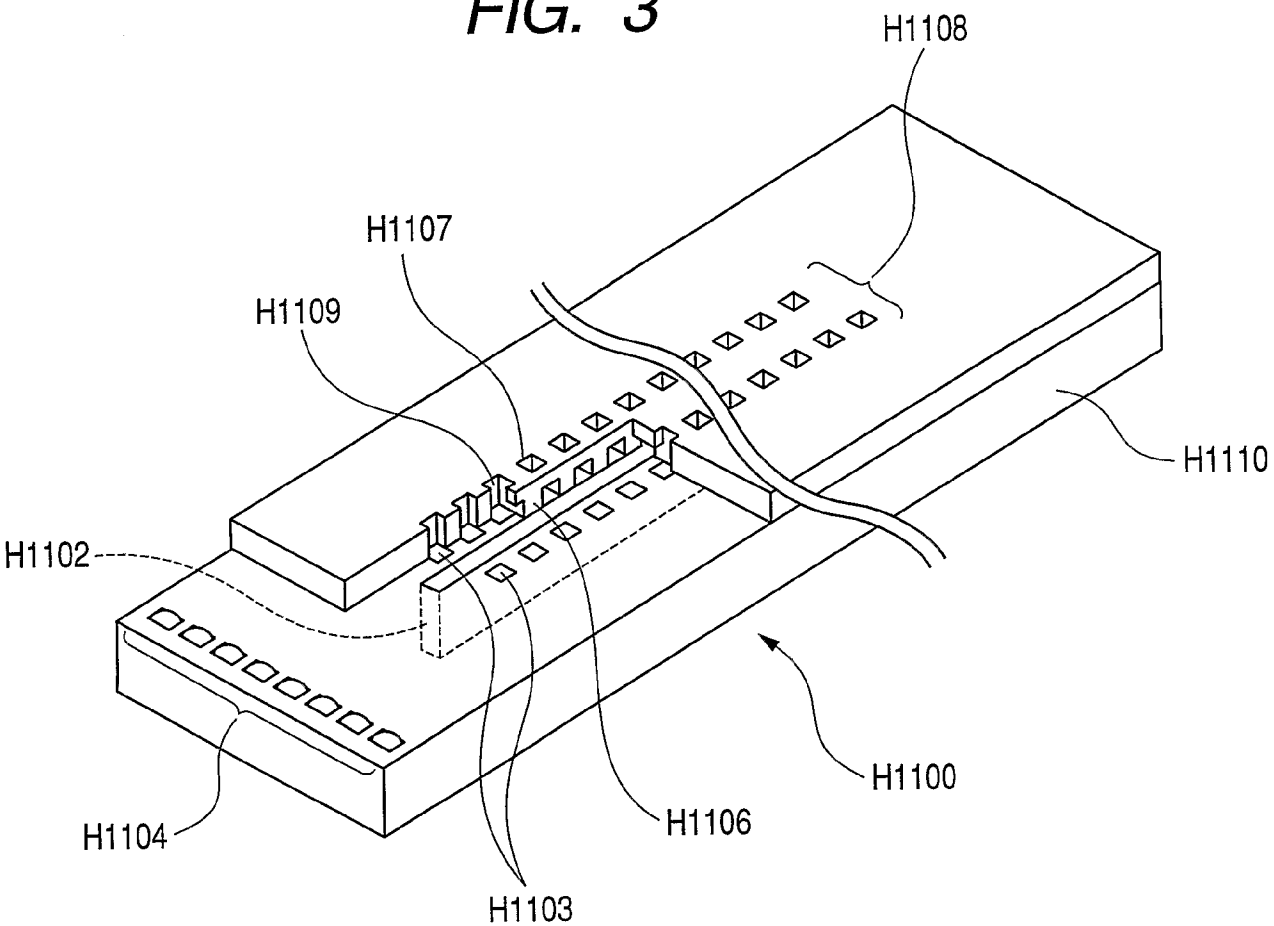
FIG. 3 is a perspective view in which the ink jet recording head shown in FIG. 2 is partially enlarged.

FIG. 1 is an exterior perspective view showing the entirety of an ink-jet recording head as a first embodiment of the present invention, and FIG. 2 is a schematic perspective view of a liquid discharge substrate for use in the ink jet recording head shown in FIG. 1. FIG. 3 is a perspective view in which the ink jet recording head shown in FIG. 2 is partially enlarged.

Figure 4:
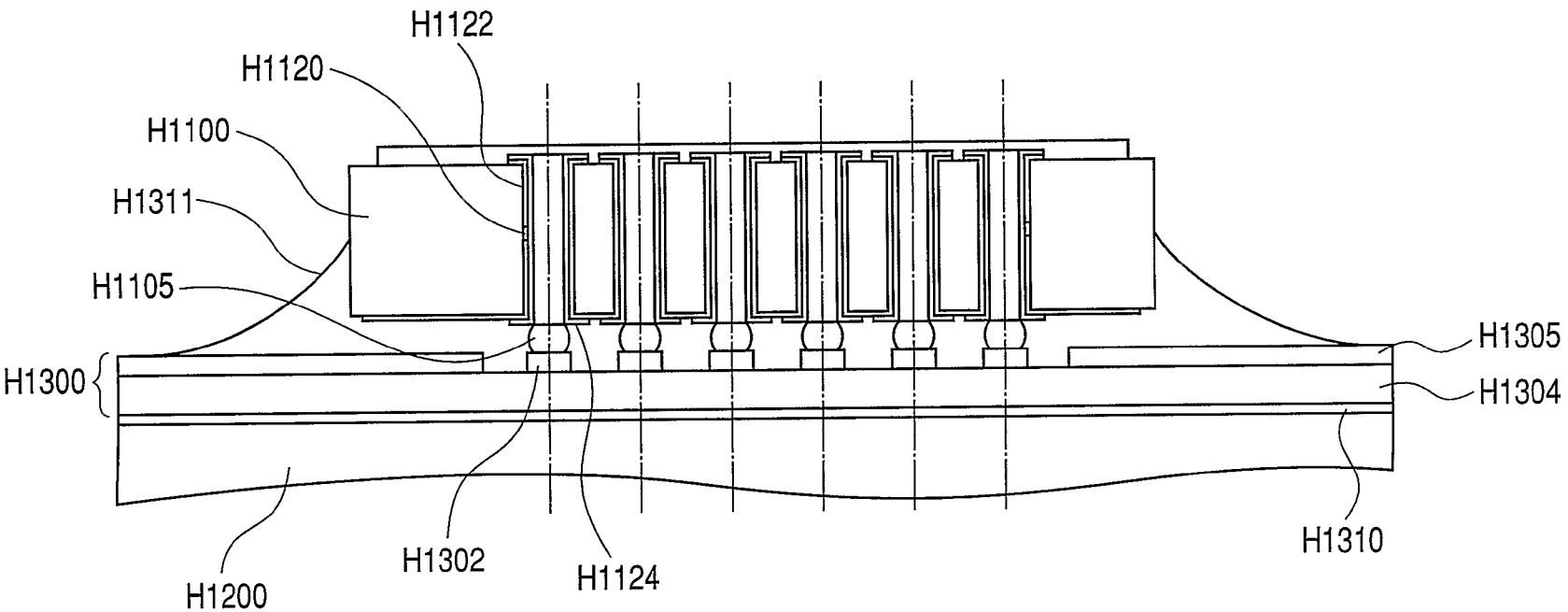
FIG. 4 is a schematic diagram showing a 4-4 cross-section in FIG. 1, which is a cross-sectional view of vicinities of electrodes.
Figure 5:
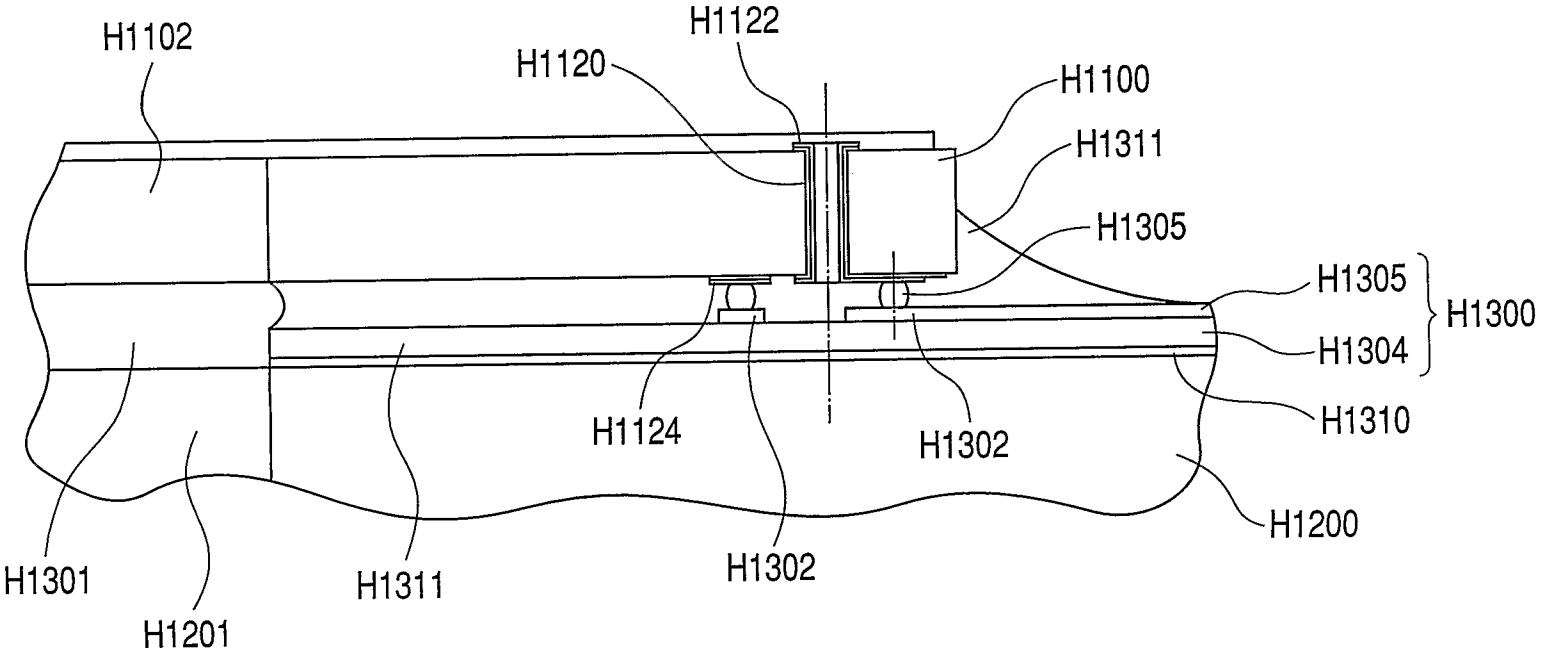
FIG. 5 is a schematic diagram showing a 5-5 cross-section in FIG. 1.
Figure 6:
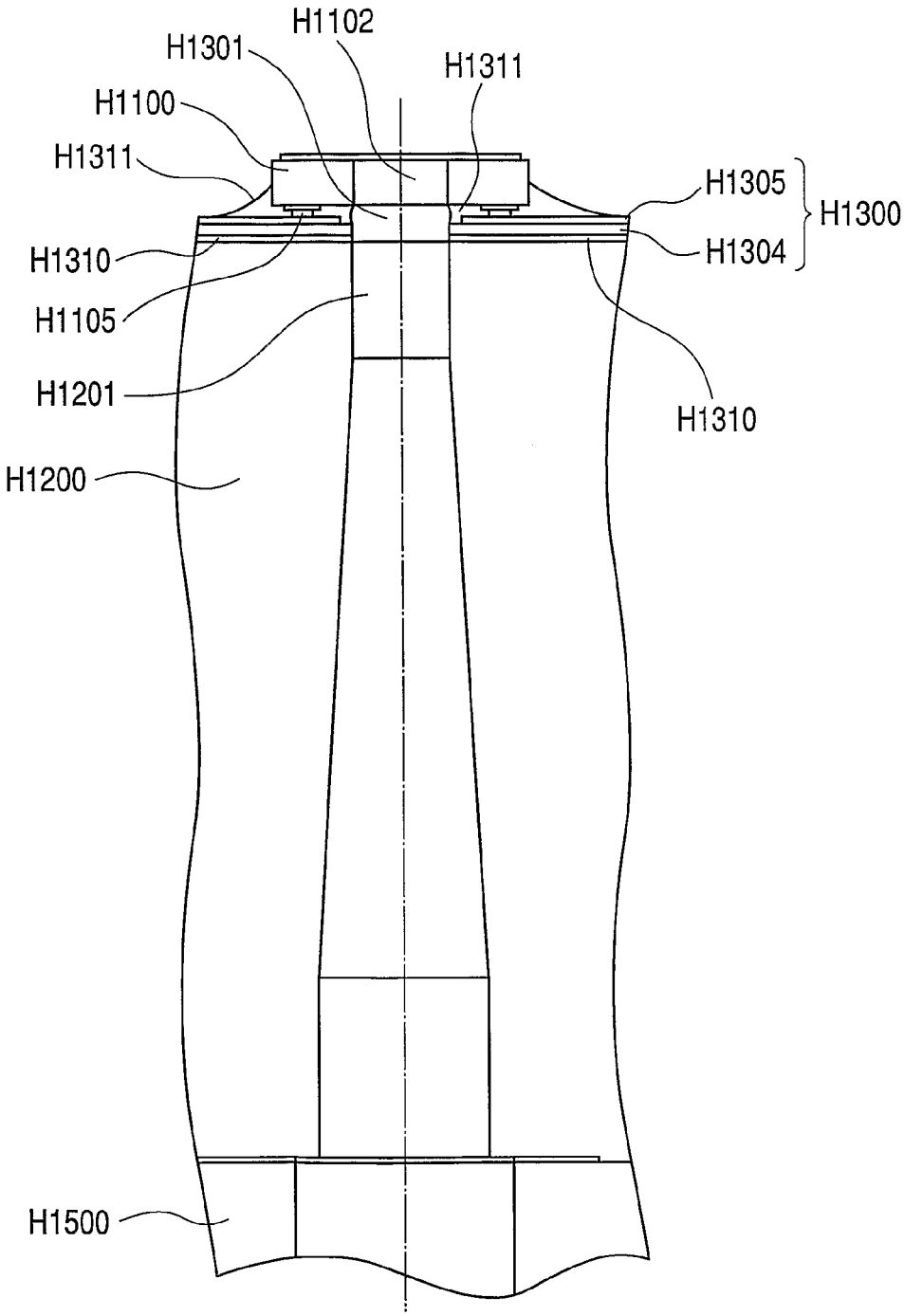
FIG. 6 is a schematic diagram showing a 6-6 cross-section in FIG. 1.

FIG. 4 is a schematic diagram showing a 4-4 cross-section in FIG. 1, which is a cross-sectional view of vicinities of electrodes. FIG. 5 is a schematic diagram showing a 5-5 cross-section in FIG. 1. FIG. 6 is a schematic diagram showing a 6-6 cross-section in FIG. 1.

The recording head H1001 shown in FIG. 1 is fixedly supported by positioning means and electrical contacts of a carriage (not shown) mounted on a body of an ink jet recording apparatus. An ink tank (not shown) is freely detachable from the recording head H1001. The ink tank is made replaceable, so running cost of recording in the ink jet recording apparatus is reduced.

As shown in FIG. 2 and FIG. 3, to a liquid discharge substrate H1100 of the recording head H1001, discharge ports H1107 for discharging a recording liquid (for example, ink) open. The discharge ports H1107 form plural arrays, thereby forming arrays H1108 of the discharge ports. On a back surface side of the arrays H1108 of the discharge ports, a liquid supply port H1102 for supplying the recording liquid opens with a length substantially equal to a length of the arrays H1108 of the discharge ports. The recording liquid from the liquid supply port H1102 enters bubbling chambers H1109, the recording liquid is bubbled by electrothermal converting elements H1103 such as heaters, and the recoding liquid will be discharged from the discharge ports H1107. Further, plural electrodes H1104 for sending electrical signals are formed on an end of the liquid discharge substrate. From the electrodes H1104, penetrating wiring H1122 penetrating the liquid discharge substrate H1100 as shown in FIG. 4 is provided, and the wiring is connected to back surface electrodes H1124 formed on a back surface side of the liquid discharge substrate.

Further, as shown in FIG. 4 and FIG. 5, on the end of the liquid discharge substrate H1100, the electrodes for sending the electrical signals, and the like are formed. To the liquid discharge substrate H1100, through holes H1120 formed by a laser, etching and so on open, and the penetrating wiring H1122 connecting electrical wiring on the surface of the liquid discharge substrate H1100 to the back surface electrodes H1124 is formed on the through holes H1120.

In this embodiment, a flexible wiring board H1300 is disposed as a film-like electrical wiring member under the liquid discharge substrate H1100. On electrode terminals H1302 formed on a wiring layer H1305 of the flexible wiring board H1300, bumps H1105 are formed. Further, the bumps H1105 and the back surface electrodes H1124 are joined to each other, and an electrical connection is thus made, and electrical power or an electrical signal necessary to discharge the recording liquid is supplied from the flexible wiring board H1300 to the liquid discharge, substrate H1100. The electrically joined portions are sealed by a sealing agent (or adhesive) H1311, and the electrically joined portions are protected from corrosion owing to the recording liquid, impact and the like.

A retaining member H1200 is provided under the flexible wiring board H1300, and the retaining member H1200 and the flexible wiring board H1300 are joined to each other by an adhesive H1310.

As shown in FIG. 6, a liquid supply port H1201 is formed in the retaining member H1200, and a liquid supply hole H1301 is formed in the flexible wiring board H1300. The liquid supply port H1201 of the retaining member H1200, the liquid supply hole H1301 of the flexible wiring board H1300, and the liquid supply port H1102 of the liquid discharge substrate H1100 communicate with one another while making centerlines thereof coincide with one another, so that the recording liquid supplied from a liquid supply member H1500 will be supplied to the liquid discharge substrate H1100. Although the bumps H1105 shown in FIG. 6 may be used for sending the electrical signals, the bumps H1105 may also be used for the purpose of heat radiation to dissipate heat generated by the discharge from the liquid discharge substrate H1100 to the retaining member H1200 through the flexible wiring board H1300.

The electrically joined portions formed of the bumps H1105 and the like are sealed by the sealing agent (or adhesive) H1311, and are completely isolated from the recording liquid from the liquid supply port. Further, the periphery of the liquid supply port H1102 of the liquid discharge substrate H1100 is completely hermetically sealed by the sealing agent H1311, and isolated from the outside of the liquid discharge substrate, thereby preventing an unnecessary leak of the recording liquid to the outside.

In this embodiment, a member to be joined to the liquid discharge substrate H1100 is the flexible wiring board H1300. Hence, opening dimension and position of the liquid supply hole H1301 of the flexible wiring board H1300, which corresponds to the liquid supply port H1102 of the liquid discharge substrate H1100, can be formed accurately and finely. Accordingly, at the time of electrically connecting the liquid discharge substrate H1100 and the flexible wiring board H1300 to each other, a positional displacement resulting from component accuracies of the liquid supply port H1102 of the liquid discharge substrate H1100 and the liquid supply hole H1301 of the flexible wiring board H1300 is less prone to occur. As a result, supply of the liquid to the liquid discharge substrate H1100 is smoothly performed. Further, at a time of filling the adhesive or sealing agent H1311 between the liquid discharge substrate H1100 and the flexible wiring board H1300 for the purpose of preventing the liquid from entering the electrical connection portions from the liquid supply port by surely sealing the electrical connection portions, the opening dimension and position of the liquid supply hole H1301 are accurately formed as described above, and accordingly, the adhesive or the sealing agent can be prevented from entering the liquid supply port H1102 of the liquid discharge substrate H1100.

Figure 7A:
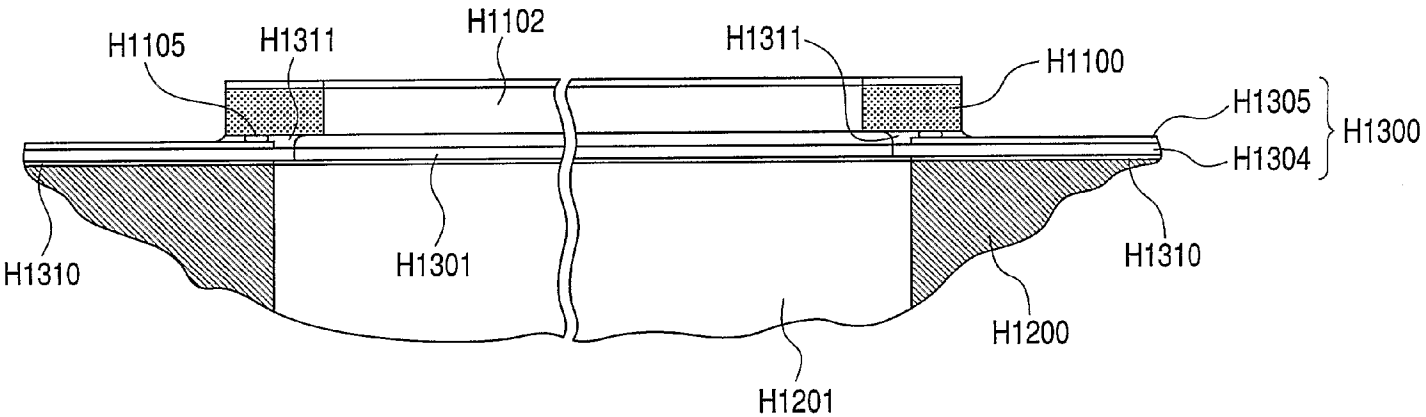
FIG. 7A is a 5-5 cross-sectional view in FIG. 1.
Figure 7B:
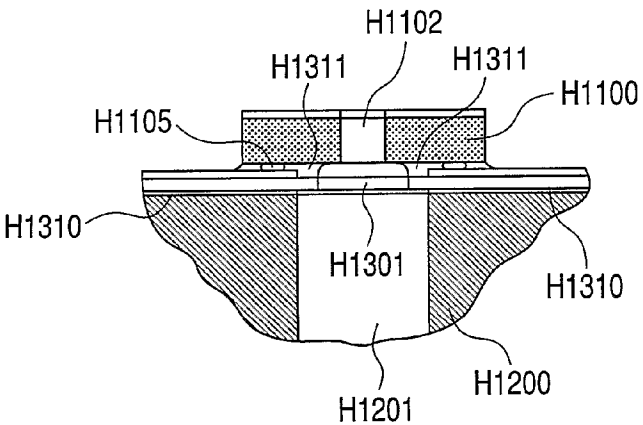
FIG. 7B is a 6-6 cross-sectional view in FIG. 1.

In addition, as shown in FIGS. 7A and 7B, the liquid supply port H1301 of the flexible wiring board H1300 is made larger than the liquid supply port H1102 of the liquid discharge substrate H1100, and further, the liquid supply port H1201 of the retaining member H1200 is made larger than the liquid supply hole H1301 of the flexible wiring board H1300. For example, when it is assumed that a size of the rectangular liquid supply port H1102 in the liquid discharge substrate H1100 is 0.1 mm×26 mm, a size of the rectangular liquid supply hole H1301 in the flexible wiring board H1300 is set at 0.2 mm×26.5 mm, and a size of the rectangular liquid supply port H1201 in the retaining member H1200 is set at 0.4 mm×27 mm.

Hence, an end of the liquid supply hole H1301 of the flexible wiring board H1300 protrudes to the inside of the liquid supply port H1201 of the retaining member H1200, and does not reach a position of the liquid supply port of the liquid discharge substrate. Therefore, at a position of the end of the liquid supply hole H1301 of the flexible wiring board H1300, which can be accurately formed, a position of the adhesive or sealing agent H1311 filled between the liquid discharge substrate H1100 and the flexible wiring board H1300 can be determined.

In addition, the liquid supply port for supplying the recording liquid to the liquid discharge substrate can be set at the end of the liquid supply hole H1301 of the flexible wiring board H1300, and accordingly, the size of the liquid supply port H1201 of the retaining member H1200 can be formed to be relatively large. Therefore, even at a time when the retaining member is made of ceramics such as alumina, the liquid supply port can be formed relatively easily, and flow resistance of the liquid to the liquid discharge substrate H100 does not offer a problem, either. Further, since the retaining member H1200 has a thickness of approximately 1 mm to 4 mm, bubbles are accumulated in the supply port and the flow resistance is increased when an opening width of the liquid supply port H1201 formed in the retaining member H1200 is narrow, causing a possibility to adversely affect the discharge. However, in this embodiment, the width of the liquid supply port of the retaining member H1200 can be made larger than the width of the liquid supply hole H1301 of the flexible wiring board H1300, and accordingly, the flow resistance of the liquid supply port can be reduced, and in addition, such bubble pool in the liquid supply port can be prevented.

In the entire construction described so far, the coating and filling of the adhesive or the sealing agent may be performed either before or after making the electrical connection between the liquid discharge substrate H1100 and the flexible wiring board H1300.

Further, in this embodiment, with regard to the joining of the back surface electrodes H1124 of the liquid discharge substrate H1100 and the electrode terminals H1302 of the flexible wiring board H1300, a mode of joining by means of metal bumps such as gold bumps is shown. However, joining by means of a conductive adhesive, and a method of bringing the electrodes into press-contact with each other by means of a thermosetting adhesive, may also be used. Further, no problem occurs if the thermosetting adhesive contains conductive particles.

Note that this embodiment has a construction in which one liquid discharge substrate is mounted per one recording head, and the arrays of the discharge ports on the liquid discharge substrate are one set. Therefore, by means of one recording head, only recording with no more than a single color can be made. However, multicolor recording will be enabled by using a plurality of the recording heads.

Second Embodiment

Next, while a second embodiment of the present invention will be described, points different from those of the first embodiment will be mainly described here.

Figure 8A:
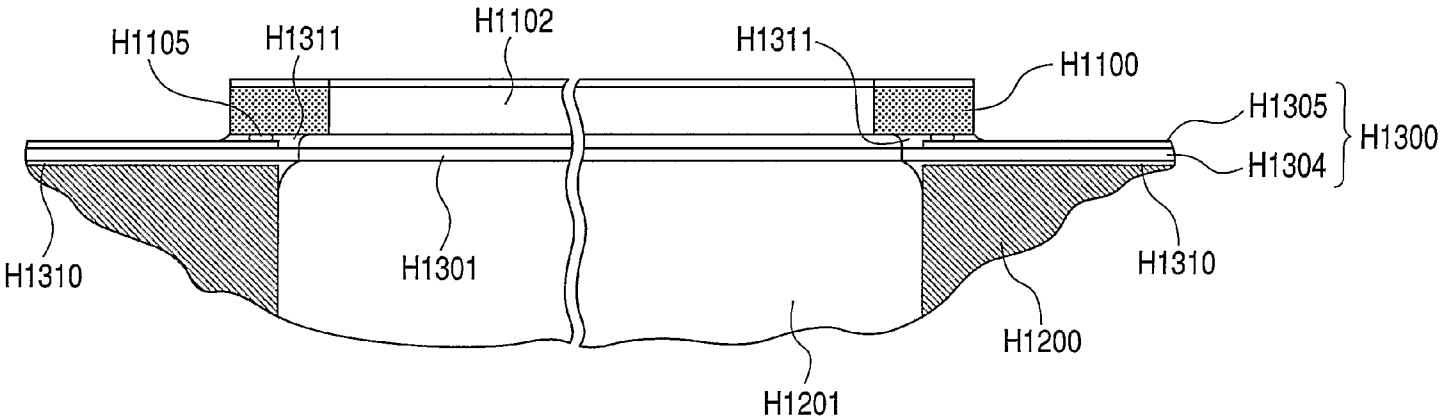
FIGS. 8A and 8B are views showing a second embodiment of the present invention.
Figure 8B:
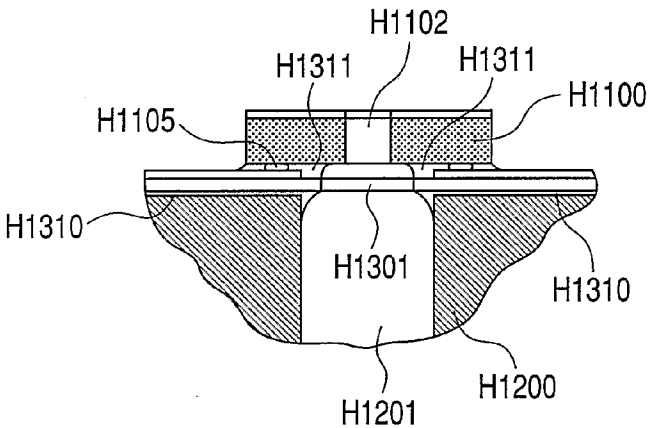
Figure 9:
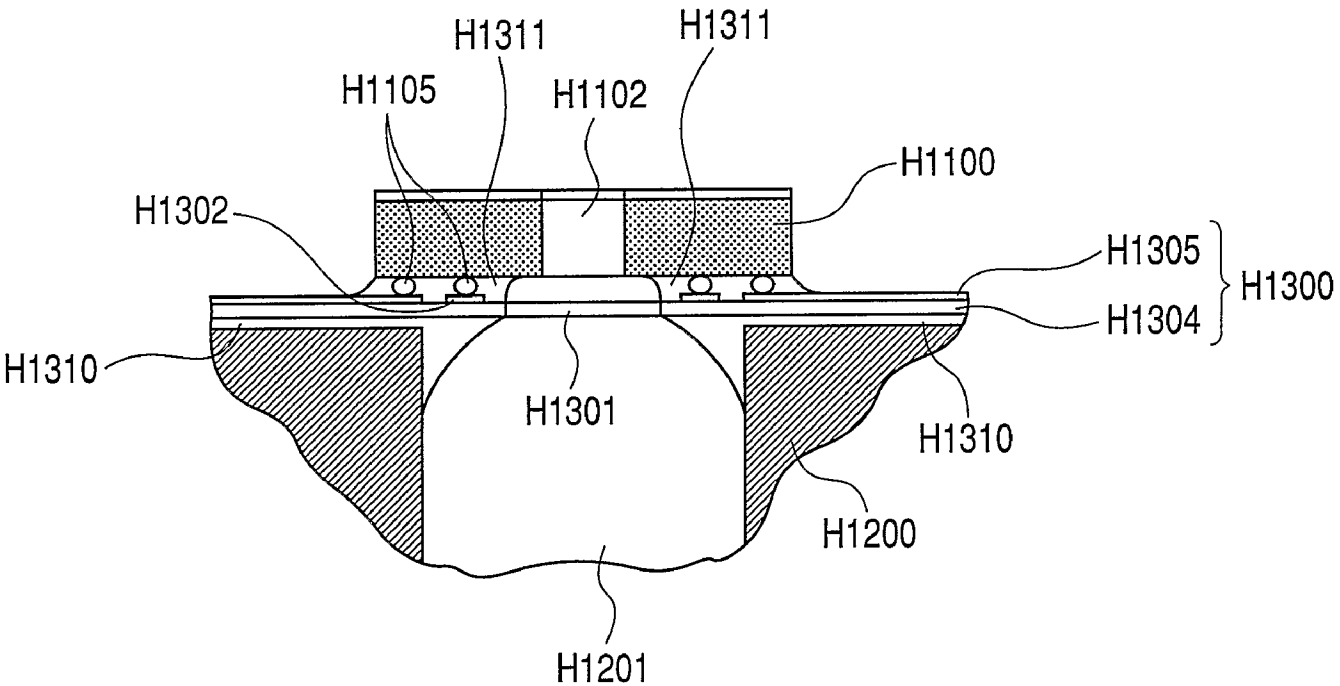
FIG. 9 is a view showing a modification example of the second embodiment of the present invention, and is a schematic diagram showing the 6-6 cross-section in FIG. 1.

FIGS. 8A and 8B are views showing the second embodiment of the present invention: FIG. 8A is a schematic diagram showing the 5-5 cross-section in FIG. 1; and FIG. 8B is a schematic diagram showing the 6-6 cross-section in FIG. 1. FIG. 9 is a view showing a modification example of the second embodiment of the present invention, and is a schematic diagram showing the 6-6 cross-section in FIG. 1.

This embodiment has a construction, in which the adhesive H1310 is made to squeeze out at the time of adhering the flexible wiring board H1300 and the retaining member H1200 to each other, and a back surface portion of the flexible wiring board H1300, which protrudes to the liquid supply port 1201 of the retaining member H1200, is supported by the adhesive H1310.

With this construction, a peripheral portion of the liquid supply port H1201 of the retaining member H1200, which is covered with the flexible wiring board H1300, is buried with the adhesive. Accordingly, mechanical strength of this portion is increased, and a connection reliability between the back surface electrodes (not shown) of the liquid discharge substrate H1100 and the electrode terminals (not shown) of the wiring layer H1305 of the flexible wiring board H1300 is increased. In addition, a flow of the liquid in the liquid supply port is smoothened, the bubble pool and the like can also be prevented, and a recording reliability is improved.

Here, the construction to squeeze out the adhesive filled between the flexible wiring board H1300 and the retaining member H1200 into the liquid discharge port H1201 has been described. However, after the flexible wiring board H1300 is adhered and fixed to the retaining member H1200, another adhesive may be applied onto a corner portion formed of the back surface of the flexible wiring member H1300 and an opening end of the liquid supply port H1201 of the retaining member H1200.

Further, the flexible wiring member H1300 is adhered and fixed to the retaining member H1200 by the adhesive H1300, and in the head construction of the present invention, it is necessary to adhere and fix lower portions of the electrode terminals of the flexible wiring board H1300 particularly tightly in order to join the electrode terminals (not shown) of the wiring layer H1305 of the flexible wiring board H1300 and the back surface electrodes (not shown) of the liquid discharge substrate H110 to each other.

However, in some cases, the electrode terminals of the flexible wiring board H1300 are arranged in the vicinity of the liquid supply hole H1301, and there will occur a case where the electrical connection must be made at a portion of the flexible wiring board H1300, which protrudes to an inner portion of the liquid discharge port H1201 of the retaining member H1200.

Accordingly, in this embodiment, as shown in FIG. 9, adopted is a construction to support, by the adhesive, the electrical connection portions of the flexible wiring board H1300, which protrude to the liquid supply port H1201 of the retaining member H1200.

Such a portion of performing the support by the adhesive may be formed by squeezing out the adhesive H1310 for adhering the flexible wiring board H1300 to the retaining member H1200, or may be formed by applying the adhesive after adhering and fixing the flexible wiring board H1300 to the retaining member H1200. In this case, no problem occurs if another type of adhesive than the adhesive for adhering and fixing the flexible wiring board H1300 is used.

With the construction described above, even if, in order to surely seal the electrical connection portions by the adhesive or the sealing agent filled between the liquid discharge substrate H1100 and the flexible wiring board H1300 and to prevent the liquid entering from the liquid supply port, the adhesive or the sealing agent is sufficiently applied or filled therebetween and squeezes out to the inside of the liquid supply port H1301 of the flexible wiring board H1300, the liquid supply port H1301 has some distance from the liquid supply port H1105 of the liquid discharge substrate H1100, and accordingly, the adhesive or the sealing agent can be prevented from entering the liquid supply port H1102 of the liquid discharge substrate H1100. Further, even if the electrical connection portions are formed in the portion of the flexible wiring board H1300, which protrudes to the liquid supply port H1201 of the retaining member H1200, the electrical connection is surely enabled.

Hence, with the construction described above, an inexpensive head, in which reliabilities in the electrical connection and the ink supply are high, can be provided.

Third Embodiment

Next, while a third embodiment of the present invention will be described, points different from those of the first embodiment will be mainly described here.

Figure 10:
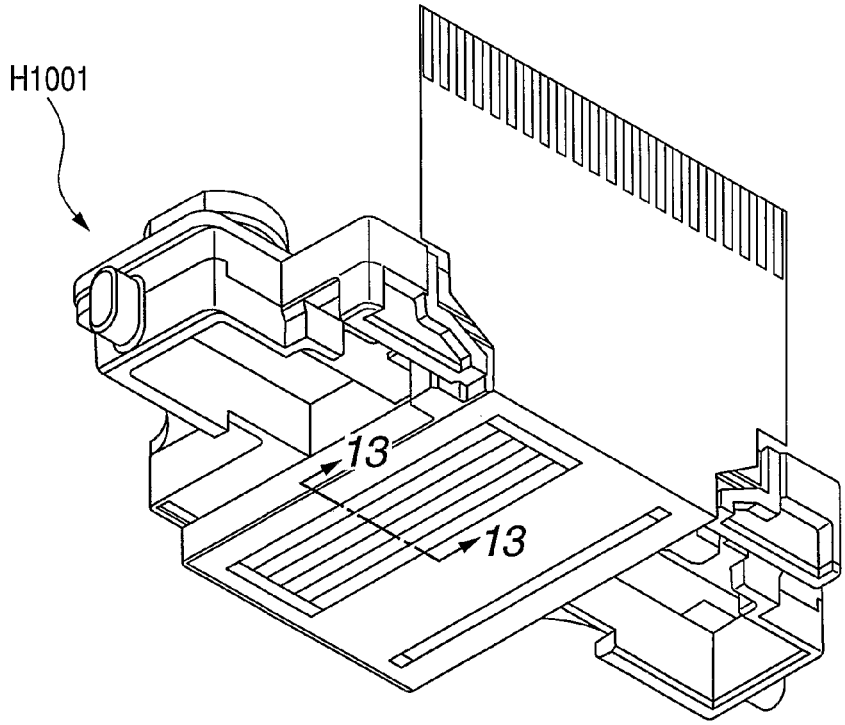
FIG. 10 is a schematic perspective view showing the entirety of an ink jet recording head as a third embodiment of the present invention, and is a view thereof viewed from a surface side of the liquid discharge substrate.
Figure 12:
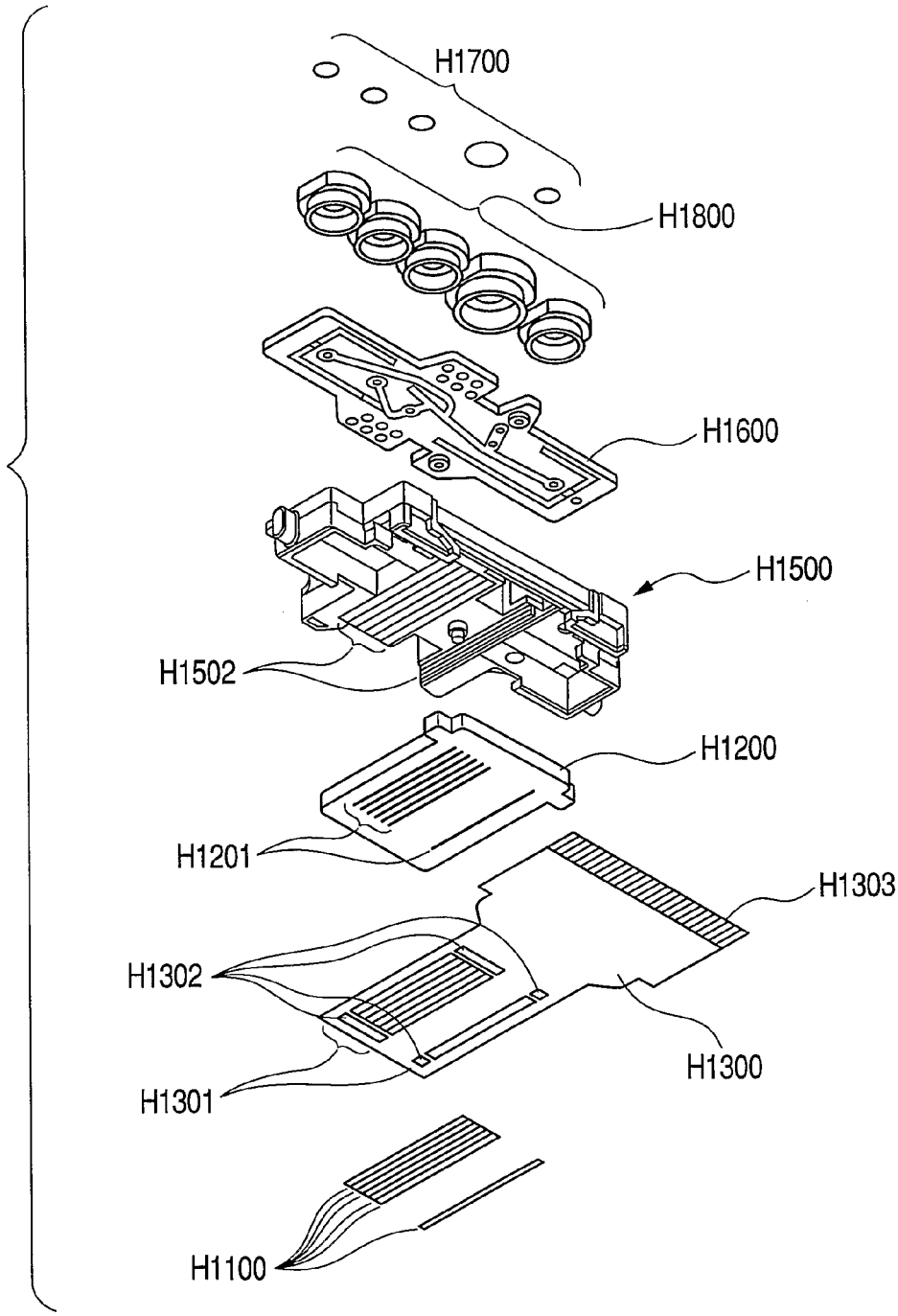
FIG. 12 is an exploded perspective view of the ink jet recording head as the second embodiment of the present invention.
Figure 13:
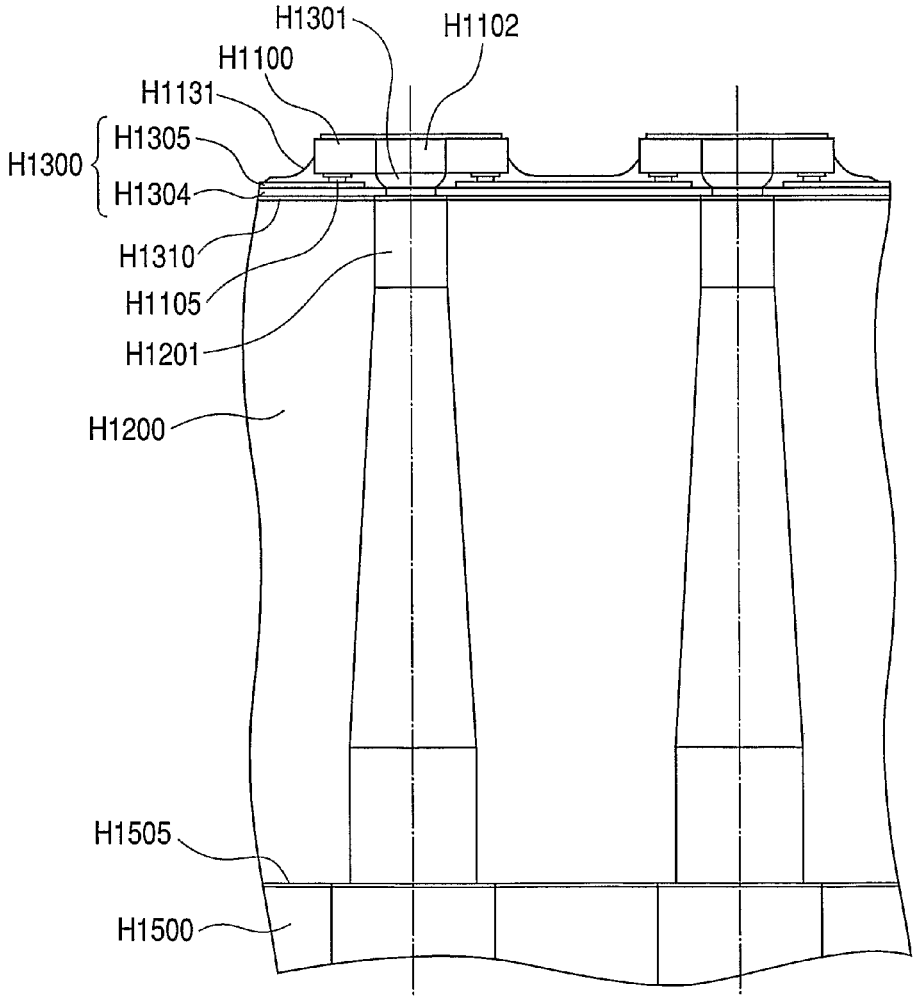
FIG. 13 is a schematic diagram showing a 13-13 cross-section in FIG. 10.

FIG. 10 is a schematic perspective view showing the entirety of an ink jet recording head as a third embodiment of the present invention, and is a view thereof viewed from a surface side of the liquid discharge substrate. Further, FIG. 11 is a view of the recording head viewed from a back surface side thereof FIG. 12 is an exploded perspective view of the ink jet recording head of this embodiment, and FIG. 13 is a schematic diagram showing a 13-13 cross-section in FIG. 10.

In comparison with the first embodiment, this embodiment has a construction in which a plurality of the liquid discharge substrates are mounted per one recording head, and the multicolor recording is enabled by means of one recording head. Accordingly, it is possible to construct the recording head to be compact, and further, members thereof are constructed to be integral together, thus making it possible to achieve a reduction of component cost and a reduction of manufacturing cost. Accordingly, the inexpensive recording head can be constructed.

As in the first embodiment, the recording head H1001 is fixedly supported by the positioning means and the electrical contacts of the carriage (not shown) mounted on the body of the ink jet recording apparatus. Further, the ink tank (not shown) is freely detachable from the recording head H1001, and the ink tank is made replaceable. However, for the purpose of the multicolor recording, adopted is a construction to mount a plurality of the ink tanks on one recording head. In this embodiment, five ink tanks are mounted.

Figure 11:
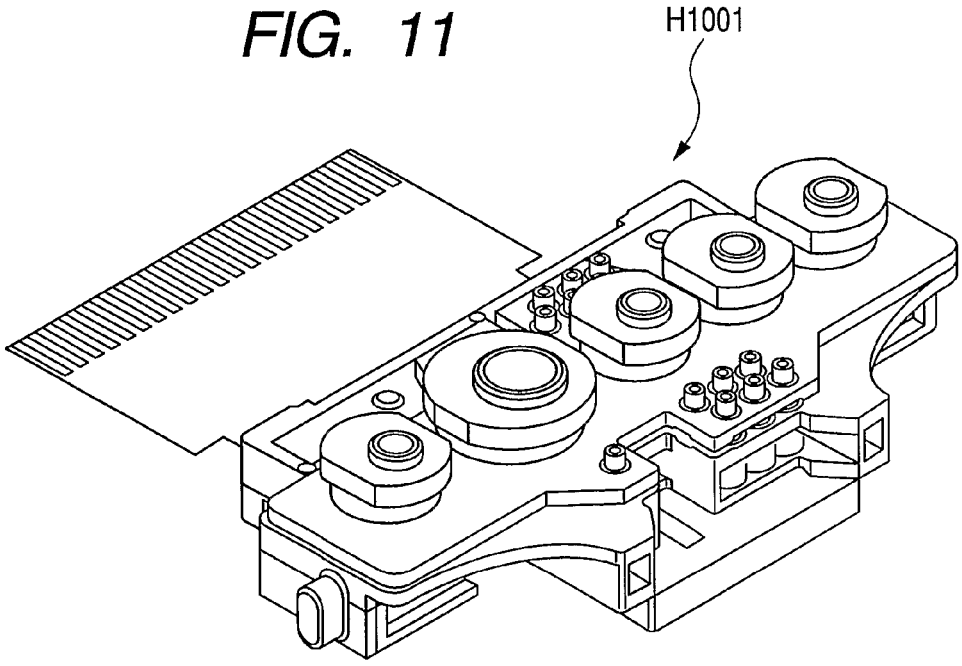
FIG. 11 is a perspective view of the recording head of FIG. 10 viewed from a back surface side thereof.

The recording head H1001 has a component construction as shown in the exploded perspective view of FIG. 11.

The recording head H1001 is composed of a plurality of the liquid discharge substrates H1100, the flexible wiring board H1300, the retaining member H1200, the first liquid supply member H1500, a second liquid supply member H1600, seal rubbers H1800, and filters H1700.

Each liquid discharge substrate H1100 is a similar one to that described with reference to FIGS. 2 and 3 of the first embodiment, and a plurality thereof is mounted on the flexible wiring board H1300. In the flexible wiring board H1300, the liquid supply holes H1301 corresponding to the respective liquid discharge substrates H1100 are formed. In a similar way, the liquid supply ports H1201 are formed also in the retaining member H1200, and the liquid supply ports H1502 are formed also in the first liquid supply member H1500 joined to the retaining member H1200. In such a way, the liquid supply ports of the respective members are joined to one another and made to communicate with one another, and the recording liquids supplied from the ink tanks (not shown) thus enter the second liquid supply member H1600 through the filters H1700. Further, the recording liquids pass through liquid passages H1601 and enter the liquid supply ports H1502, and further, sequentially pass through the liquid supply ports H1201 of the retaining member H1200, the liquid supply holes H1301 of the flexible wiring board H1301, and the liquid supply ports H1102 of the liquid discharge substrate. Then, the supply of the recording liquids is completed.

On the flexible wiring board H1300, external signal input terminals H1303 are provided, and the external signal input terminals H1303 are connected to the unillustrated carriage, and transmit electrical signals from the unillustrated ink jet recording apparatus to the liquid discharge substrates H1100.

As shown in the cross-sectional view of FIG. 13, a cross-sectional construction of this embodiment is basically similar to that of the first embodiment. However, the plurality of liquid discharge substrates H1100 are provided, and the cross-sectional construction takes component shapes corresponding thereto.

The electrical connection portions are also sealed by the sealing agent (or adhesive) H1311, and are completely isolated from the recording liquids from the liquid supply ports. The peripheries of the liquid supply ports H1102 of the liquid discharge substrate H1100 are also completely hermetically sealed by the sealing agent H1311, and are isolated from the outside of the liquid discharge substrates, thereby preventing the unnecessary leak of the recording liquids to the outside. Further, a leak of the recording liquids between the liquid discharge substrates causes a color mixture, and accordingly, it is also necessary to accurately seal and adhere the portions concerned.

In this embodiment, at the time of mounting the plural liquid discharge substrates on the single retaining member and flexible wiring board, it is necessary to mount the liquid discharge substrates positionally accurately. In particular, in order to perform a high-definition printing, it is necessary to mount the liquid discharge substrates with high accuracy so that accuracy of relative positions of the respective liquid discharge substrates can be maintained.

In this embodiment, only the liquid discharge substrate for black is disposed separately from the other liquid discharge substrates. In such a way, a construction is made, which is suitable for the case of using, for example, reactive ink (where a reaction is caused by black and color inks) and the like.

With the construction as described above, in addition to the effect of the recording head according to the first embodiment, further, a compact and inexpensive recording head capable of performing the high-definition printing can be constructed.

Fourth Embodiment

Next, while a fourth embodiment will be described, points different from those of the first embodiment will be mainly described here.

Figure 14:
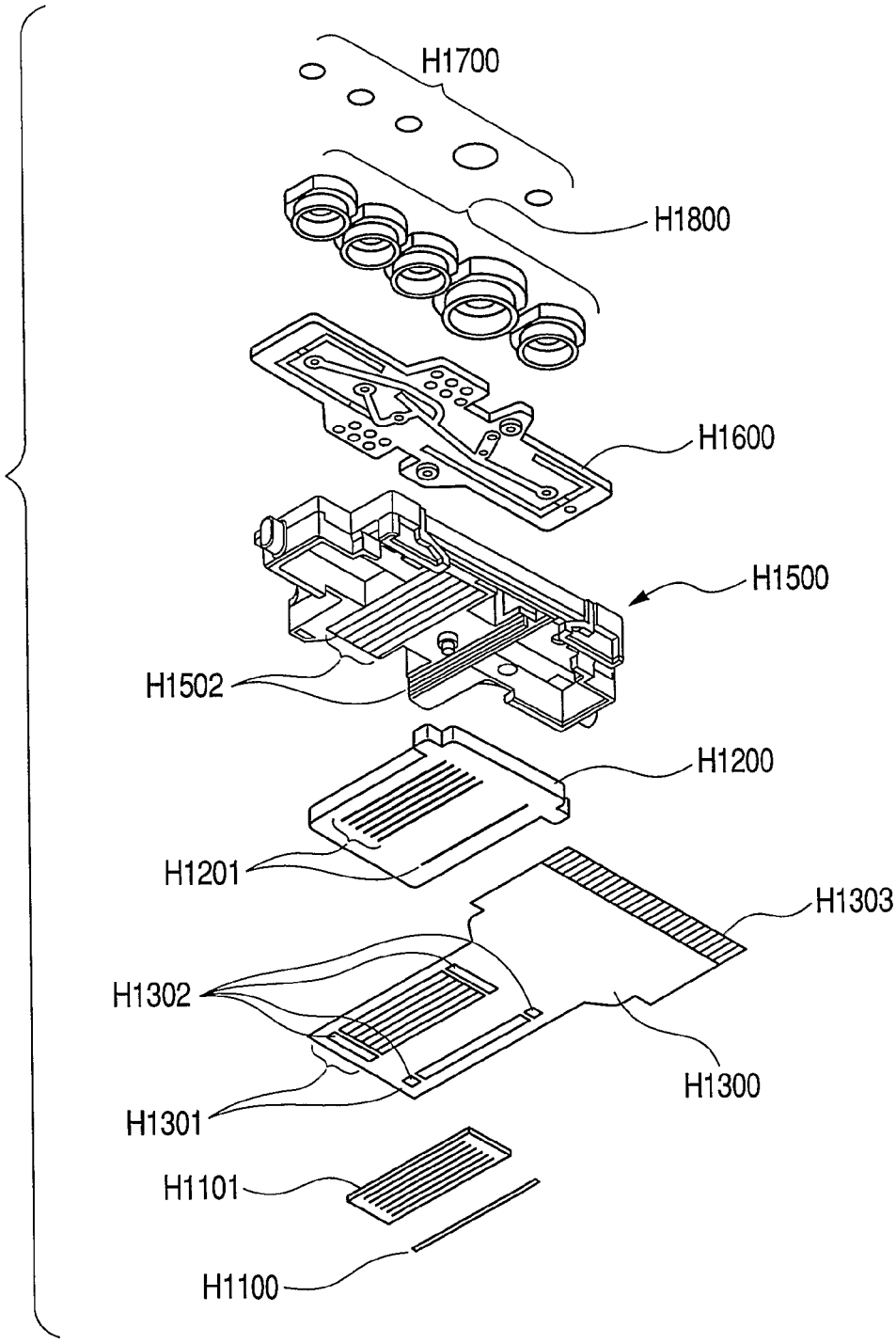
FIG. 14 is an exploded perspective view of an ink jet recording head as a fourth embodiment of the present invention.
Figure 15:
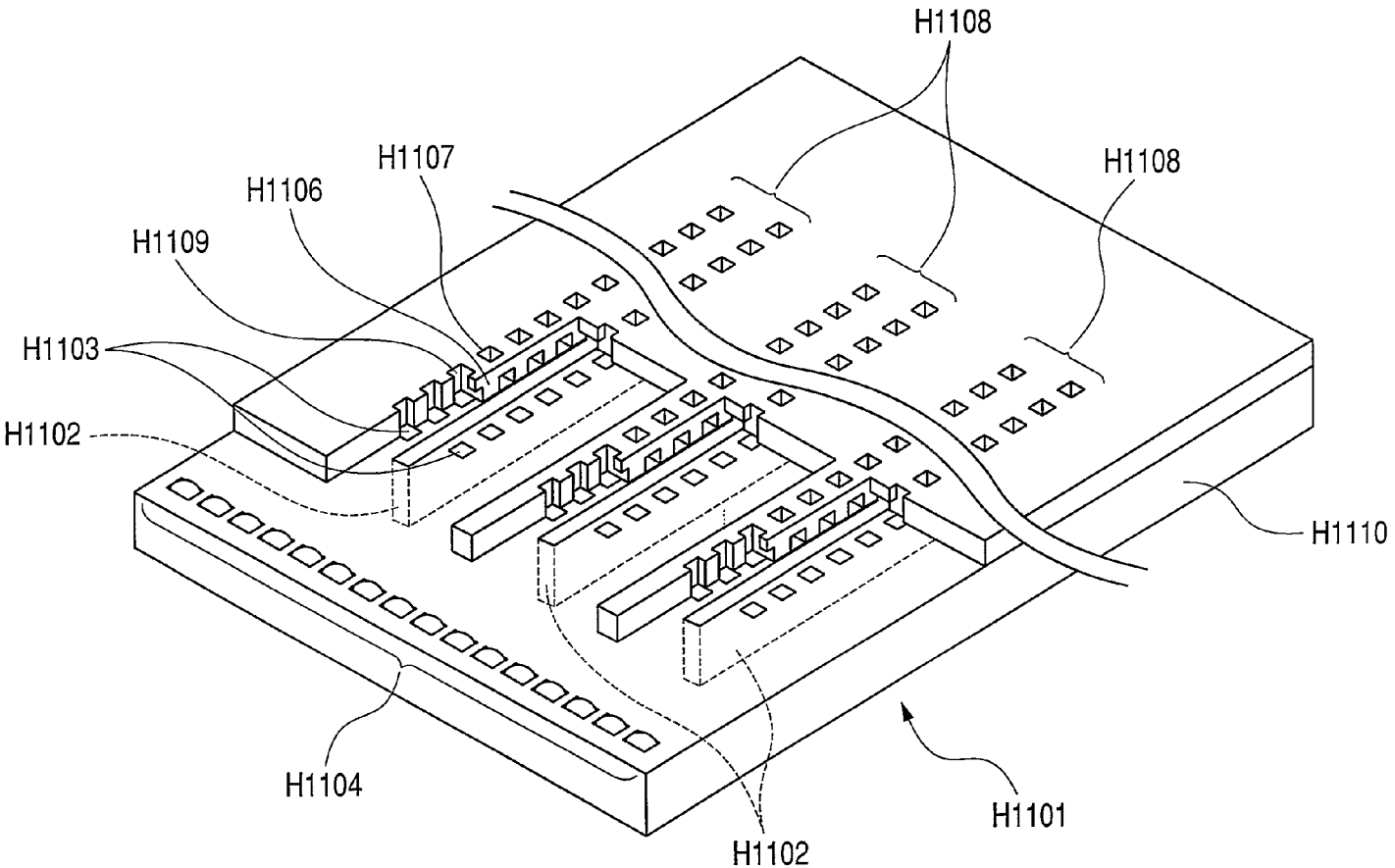
FIG. 15 is a schematic perspective view showing a part of a liquid discharge substrate for use in the ink jet recording head shown in FIG. 14.
Figure 16:
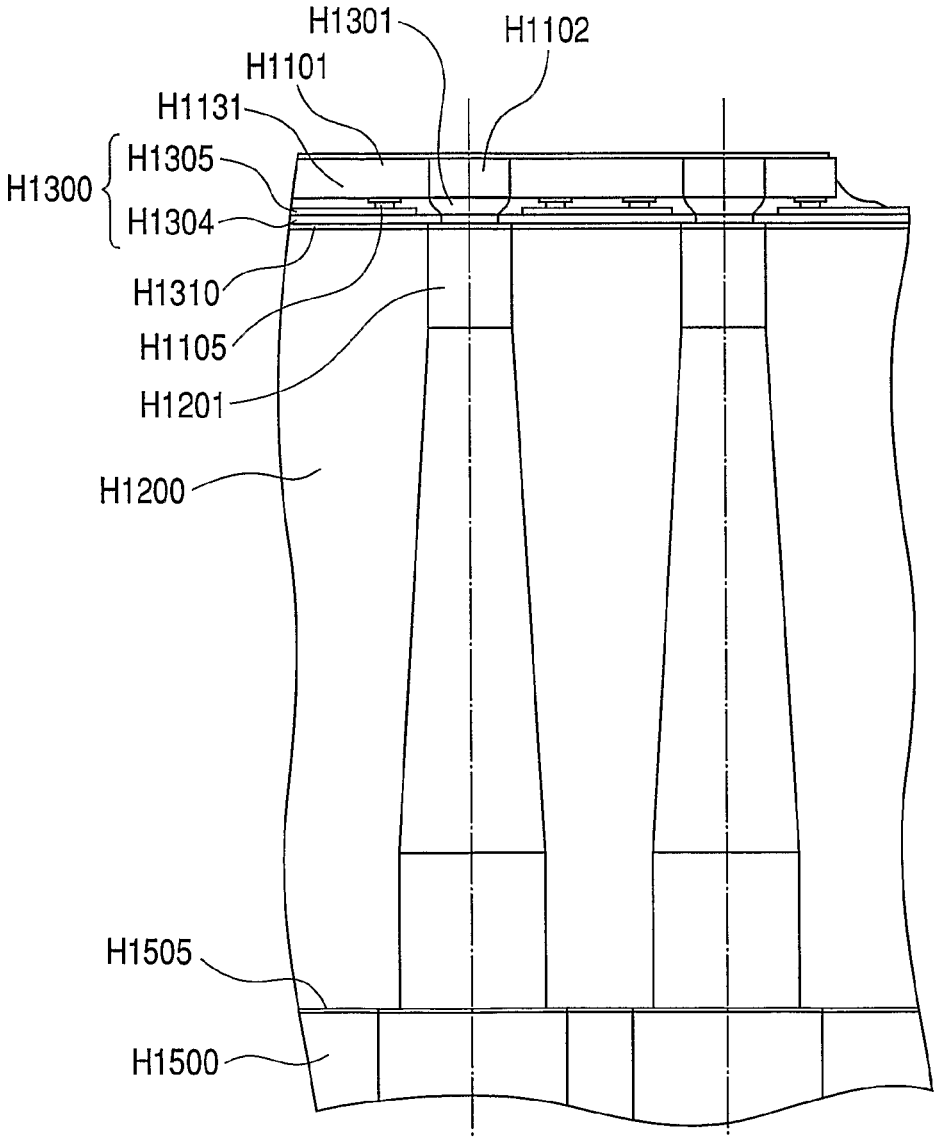
FIG. 16 is a schematic diagram showing a partial cross-section of a vicinity of the liquid discharge substrate of the ink jet recording head of FIG. 14.

FIG. 14 is an exploded perspective view of an ink jet recording head as the fourth embodiment of the present invention, and FIG. 15 is a schematic perspective view showing a part of a liquid discharge substrate for use in the ink jet recording head shown in FIG. 14. FIG. 16 is a schematic diagram showing a partial cross-section of a vicinity of the liquid discharge substrate of the recording head.

The recording head of this embodiment is similar to that of the second embodiment in basic construction, and is capable of the multicolor recording by means of one recording head, but is different therefrom in construction of the liquid discharge substrate to be mounted thereon.

The liquid discharge substrate H1100 is used for black as the liquid discharge substrate, and this is a similar one to those of the first and second embodiments. However, an integral-type liquid discharge substrate H1101 is used for colors.

FIG. 15 is one showing the integral-type of liquid discharge substrate H1101, in which the discharge ports H1107 for discharging the recording liquids (inks) open. The discharge ports H1107 form arrays, thereby forming the arrays H1108 of the discharge ports. On the back surface side of the arrays H1108 of the discharge ports, the liquid supply ports H1102 for supplying the recording liquids open with a length substantially equal to the length of the arrays H1108 of the discharge ports. The liquid supply ports H1102 are formed by the number of types of recording liquids. In this drawing, the liquid supply ports H1102 and the arrays H1108 of the discharge ports are formed for three sets, which correspond to the color inks for cyan, magenta and yellow. By increasing the liquid supply ports and the arrays of the discharge ports, recording using much more types of recording liquids will be enabled.

The recording liquids from the liquid supply ports H1102 enter the bubbling chambers H1109, the recording liquids are bubbled by the electrothermal converting elements H1103, and the recording liquids will be discharged from the discharge ports H1107. Further, the plural electrodes H1104 for sending the electrical signals are formed on the end of the liquid discharge substrate. From the electrodes H1104, unillustrated penetrating wiring penetrating the liquid discharge substrate is provided, and connected to the back surface electrodes H1124 formed on the back surface side of the liquid discharge substrate.

A cross-section of the recording head in the case of using the above-described integral-type of liquid discharge substrate H1101 is as shown in FIG. 15.

As in this embodiment, the liquid discharge substrate for the colors is integrated, and the arrays of the discharge ports for the respective colors are thus built in the one liquid discharge substrate by a semiconductor process. Accordingly, relative positions of the arrays of the discharge ports for the respective colors are arranged with high accuracy, and the high-definition recording is enabled. Further, highly accurate alignment becomes unnecessary, and yield in a manufacturing process is improved.

Further, since the wiring can be combined together in the liquid discharge substrate, the number of electrodes can be decreased, and the back surface electrodes can be arranged in relatively low density. Hence, yield in an electrical connection step is improved, and eventually, it is made possible to construct the inexpensive recording head.

Fifth Embodiment

Figure 17:
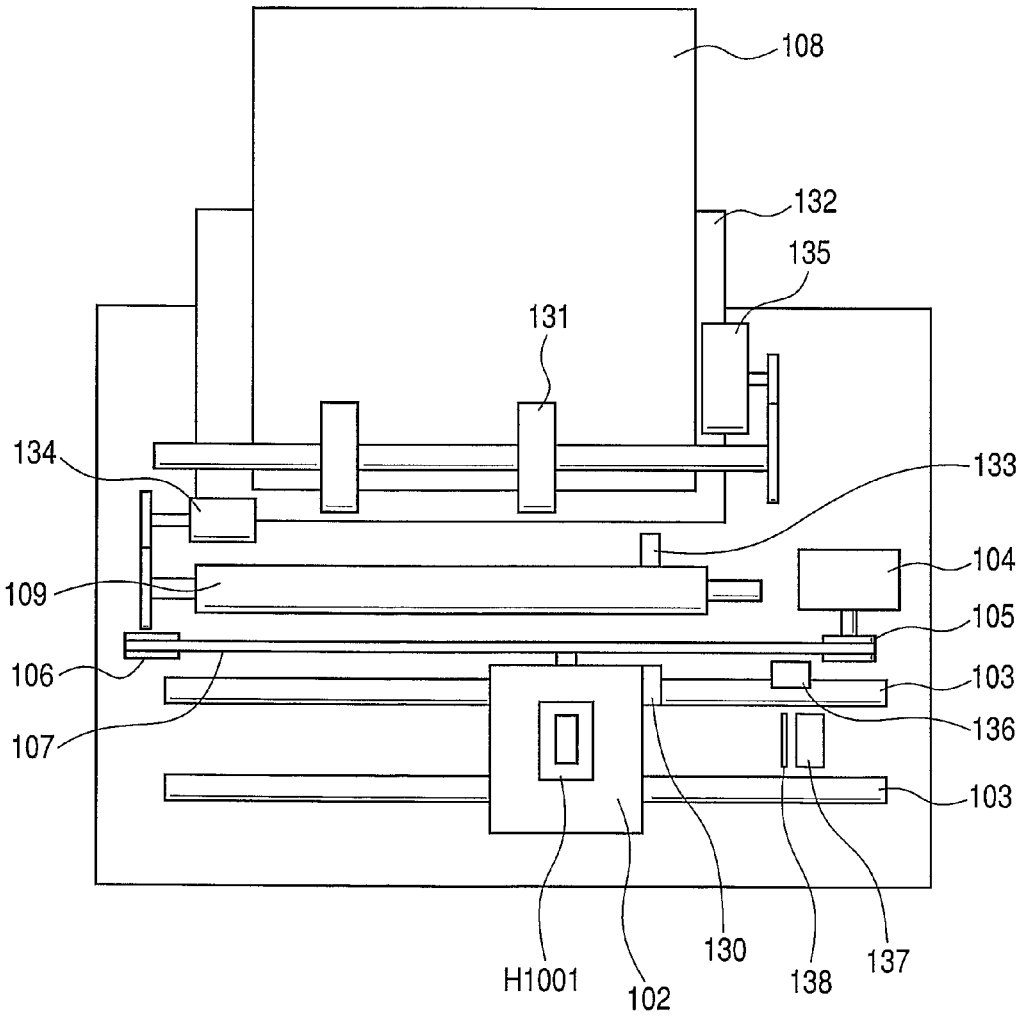
FIG. 17 is an explanatory view showing an example of a recording apparatus on which the ink jet recording head of the present invention is mountable.
Figure 18:
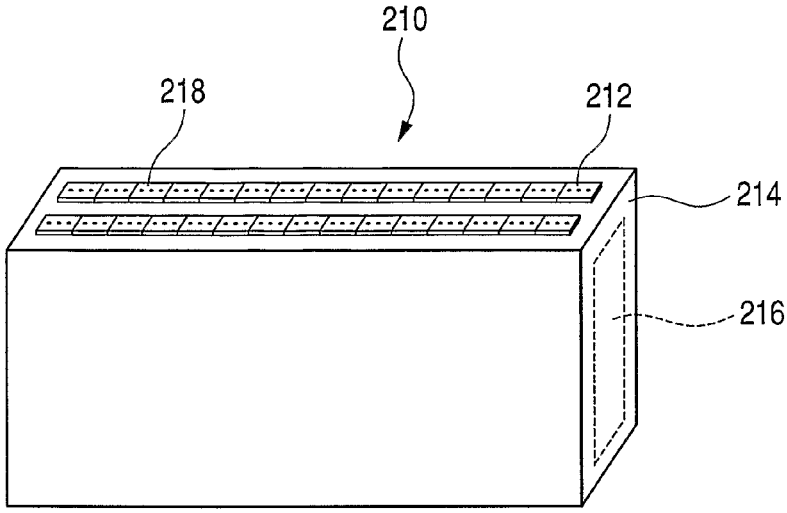
FIG. 18 is a perspective view of a wide-array ink jet pen having a printhead as a conventional example.
Figure 19:
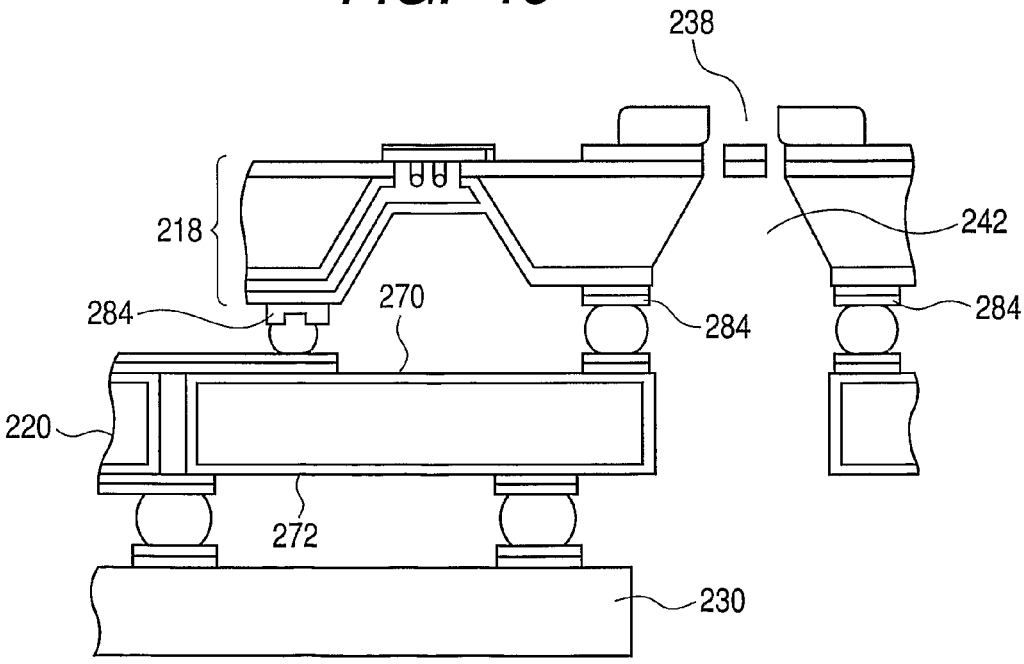
FIG. 19 is a cross-sectional view of a part having a printhead die and a carrier substrate, showing electrical connection portions of the wide-array ink jet printhead of FIG. 18.

Next, as a fifth embodiment of the present invention, a liquid discharge recording apparatus capable of mounting the recording head as described above thereon will be described. FIG. 17 is an explanatory view showing an example of the recording apparatus on which the ink jet recording head of the present invention is mountable.

In the recording apparatus shown in FIG. 17, the recording head H1001 shown in FIG. 1 or FIG. 10 is positioned on a carriage 102 and mounted thereon so as to be replaceable. In the carriage 102, there are provided electrical connection portions (not shown) for transmitting drive signals and the like to the respective arrays of the discharge ports through the electrical connection portions on the recording head H1001.

The carriage 102 is guided and supported so as to be reciprocally movable along guide shafts 103 arranged in the body of the apparatus while being extended in a main scanning direction. Then, the carriage 102 is driven by a main scanning motor 104 through drive mechanisms such as a motor pulley 105, a driven pulley 106 and a timing belt 107, and a position and movement of the carriage 102 are controlled thereby. Further, a home position sensor 130 is provided on the carriage 102. In such a way, it is made possible to get to know a position of the home position sensor 130 of the carriage 102 at the time when the home position sensor 130 passes through a position of a shielding plate 136.

At the position (home position) of the carriage, where the home position sensor 130 detects the shielding plate 136, a cap 137 for stopping up a front surface of the recording head H1001, on which the ink discharge ports are formed, is disposed. The cap 137 is used for performing ink suction recovery of the recording head by unillustrated suction means through an opening in the cap. The cap 137 can move by drive force transmitted through gears and the like, and can cover the surface of the ink discharge ports. In the vicinity of the cap 137, a cleaning blade 138 is provided. Such capping, cleaning and suction recovery are adapted to be able to be performed for the surface of the ink discharge ports of the recording head when the carriage 102 moves to the home position.

Recording mediums 108 such as recording sheets and plastic thin plates are fed from an automatic sheet feeder (hereinafter, "ASF") 132 separately one by one by rotating a pickup roller 131 from a paper feed motor 135 through gears. Further, the recording mediums are conveyed (sub-scanned) through a position (printing unit) where the recording mediums are opposed to the surface of the discharge ports of a head cartridge 1 by rotation of a conveying roller 109. The conveying roller 109 is rotated by rotation of an LF motor 134 through gears. At this time, a determination as to whether the mediums have been fed and a confirmation of a starting position at the feeding are performed at a point of time when each recording medium 108 passes through a paper end sensor 133. Further, the paper end sensor 133 is used also for grasping where a rear end of each recording medium 108 is actually present and for finally identifying a current recording position based on an actual rear end thereof.

Note that a back surface of each recording medium 8 is supported by a platen (not shown) so that the recording medium can form a flat printing surface in the printing unit. In this case, the head cartridge 1 mounted on the carriage 102 is retained so that the surface of the discharge ports thereof can protrude downward from the carriage 102 and can be parallel to the recording medium 108 between the pair of conveying rollers of the two sets.

The recording head H1001 is mounted on the carriage 102 so that an arrayed direction of the discharge ports in each array of the discharge ports can be a direction intersecting the scanning direction of the carriage 102, and the recording is performed by discharging the liquid from the arrays of the discharge ports.

In the above-described embodiment, the electrothermal converting elements for generating heat energy are provided in order to discharge the ink by using the heat energy. However, it is a matter of course that the present invention may be one to which other discharge methods such as discharging the ink by means of vibrating elements are applied.

Note that the present invention can be applied to apparatuses such as a copier, a facsimile machine having a communication system, and a word processor having a printing unit, and further, to an industrial recording apparatus combined with various processing apparatuses in a complex manner, as well as a common printing apparatus.

This application claims priority from Japanese Patent Application No. 2004-214239 filed on Jul. 22, 2004, which is hereby incorporated by reference herein.

The invention claimed is:

1. An ink jet recording head, comprising:

a liquid discharge substrate having on a front surface side a discharge port for discharging a liquid, and having on a back surface side a liquid supply port for supplying the liquid to be discharged from the discharge port, and an electrode for transmitting and receiving a signal to drive energy generation means for discharging the liquid from the discharge port;

a film-like electrical wiring member joined to the back surface of the liquid discharge substrate and including a liquid supply hole communicating with the liquid supply port of the liquid discharge substrate, and an electrical connection portion connected to the electrode; and a retaining member for retaining the liquid discharge substrate with the electrical wiring member interposed therebetween, the retaining member including a liquid supply port for supplying the liquid to the liquid supply port of the liquid discharge substrate, wherein the liquid supply hole of the electrical wiring member, the liquid supply port of the liquid discharge substrate, and the liquid supply port of the retaining member communicate with one another, the liquid supply hole of the electrical wiring member is smaller than the liquid supply port of the retaining member, and an opening end of the liquid supply hole of the electrical wiring member is located on an inner side with respect to an opening of the liquid supply port of the retaining member.

2. An ink jet recording head according to claim 1, wherein the liquid supply hole of the electric wiring member is larger than the liquid supply port of the liquid discharge substrate, and the opening end of the liquid supply hole of the electrical wiring member is located on an outer side with respect to the opening of the liquid supply port of the liquid discharge substrate.

3. An ink jet recording head according to claim 1, wherein a sealing agent for sealing the electrical connection portion is filled between the liquid discharge substrate and the electrical wiring member.

4. An ink jet recording head according to claim 1, wherein an adhesive is filled between the electrical wiring member and the retaining member, and a portion of the electrical wiring member which protrudes to an inside of the liquid supply port of the retaining member is supported by the adhesive.

5. An ink jet recording apparatus, comprising:

the ink jet recording head according to any one of claims 1 to 4; and a head retaining member for retaining the ink jet recording head such that the ink jet recording head is opposed to a recording medium.

* * * * *